US005099897A

United States Patent [19]

Curtin

[11] Patent Number: 5,099,897

[45] Date of Patent: Mar. 31, 1992

[54] COMBINATION COVER FOR GOLF CLUB BAGS AND TOWEL

[76] Inventor: James J. Curtin, 100 Pierce St., Apt. 804, Clearwater, Fla. 34616

[21] Appl. No.: 625,730

[22] Filed: Dec. 4, 1990

[51] Int. Cl.[5] ..... A63B 57/00

[52] U.S. Cl. ..... 150/159; 206/315.4

[58] Field of Search ..... 206/315.1-315.6; 150/154, 159, 160; 15/209 R; 224/274; 273/32 R-32 E

[56] References Cited

U.S. PATENT DOCUMENTS

| | | | |
|---|---|---|---|
| 1,493,828 | 5/1924 | Stocks | 206/315.4 |
| 2,144,791 | 1/1939 | Burton | 206/315.4 |
| 3,350,736 | 11/1967 | Frazelle et al. | 15/209 R X |
| 3,585,693 | 6/1971 | Barnhardt | 224/274 X |
| 4,403,366 | 9/1983 | Locke | 15/209 R |
| 4,483,380 | 11/1984 | Beran | 206/315.1 |
| 4,498,579 | 6/1984 | Baick | 206/315.4 |
| 4,516,616 | 5/1985 | Fesler | 150/154 |
| 4,771,502 | 9/1988 | Trimble | 15/209 R |
| 4,911,292 | 3/1990 | Direy, Jr. | 206/315.4 X |

FOREIGN PATENT DOCUMENTS

| | | | |
|---|---|---|---|
| 60076 | 9/1982 | European Pat. Off. | 15/209 R |
| 8902717 | 4/1989 | PCT Int'l Appl. | 15/209 R |
| 1277431 | 6/1972 | United Kingdom | 206/315.3 |

*Primary Examiner*—Sue A. Weaver

*Attorney, Agent, or Firm*—Joseph C. Mason, Jr.; Ronald E. Smith

[57] ABSTRACT

A combination towel and cover for a golf club bag. The device is a flat, foldable material having a water repellant side and a water absorbing towel side. Fastening members of the hook and loop type are positioned along selected peripheral edges of the device to hold it in a folded configuration. When fully folded, it is attachable by a clamp to a golf club bag. When unfolded, it is attachable by snap members to the snaps built into golf club bags such that its towel side is exposed for use. When so disposed, it may be flipped over the clubs to protect them during inclement weather, but the golfer may still reach under the device to use its towel side even when it has been flipped over.

5 Claims, 7 Drawing Sheets

Fig. 5
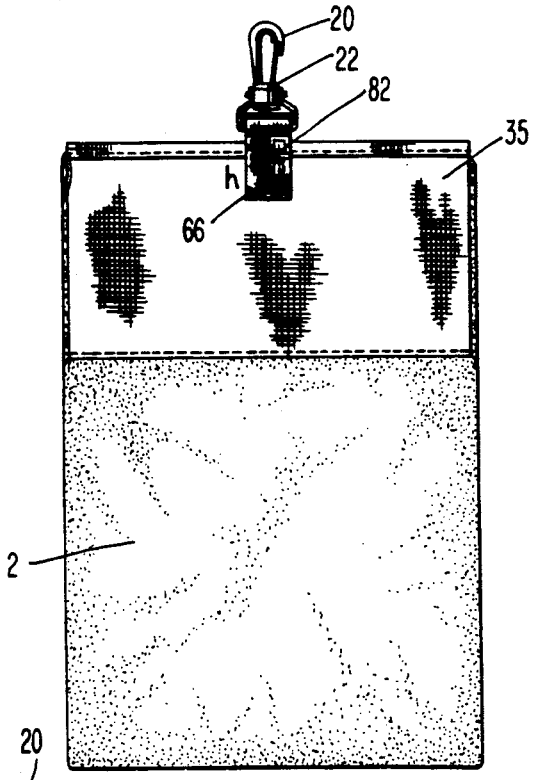
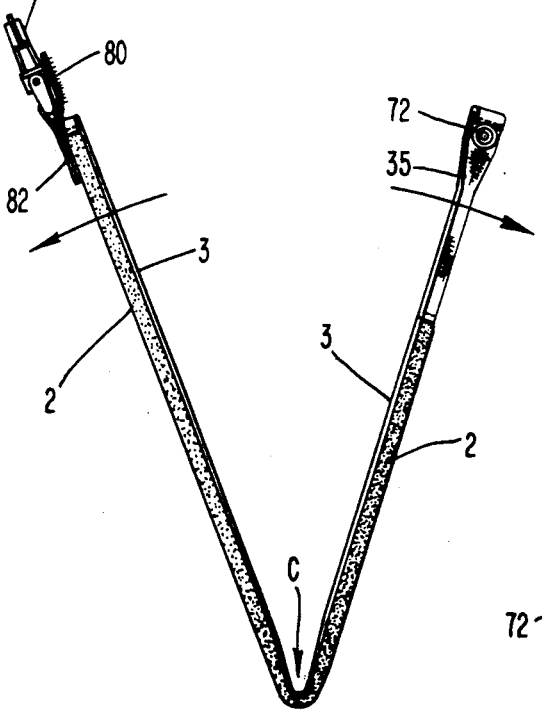
Fig. 6
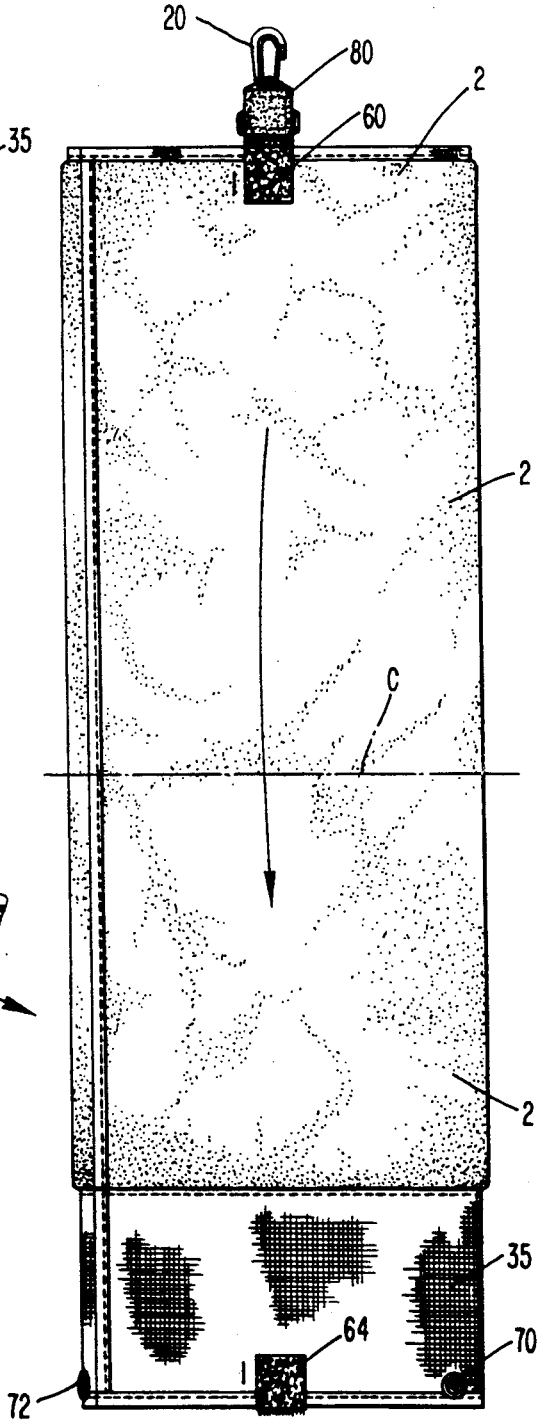
Fig. 7

Fig. 8
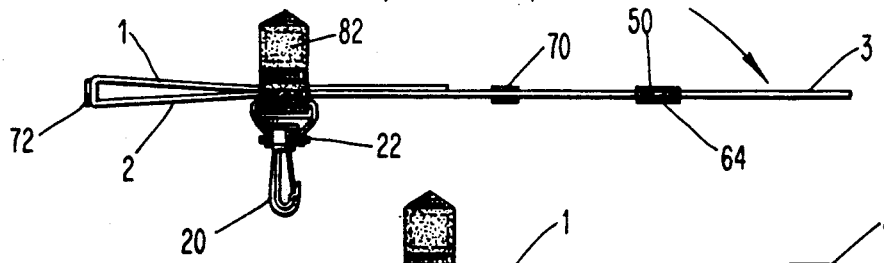
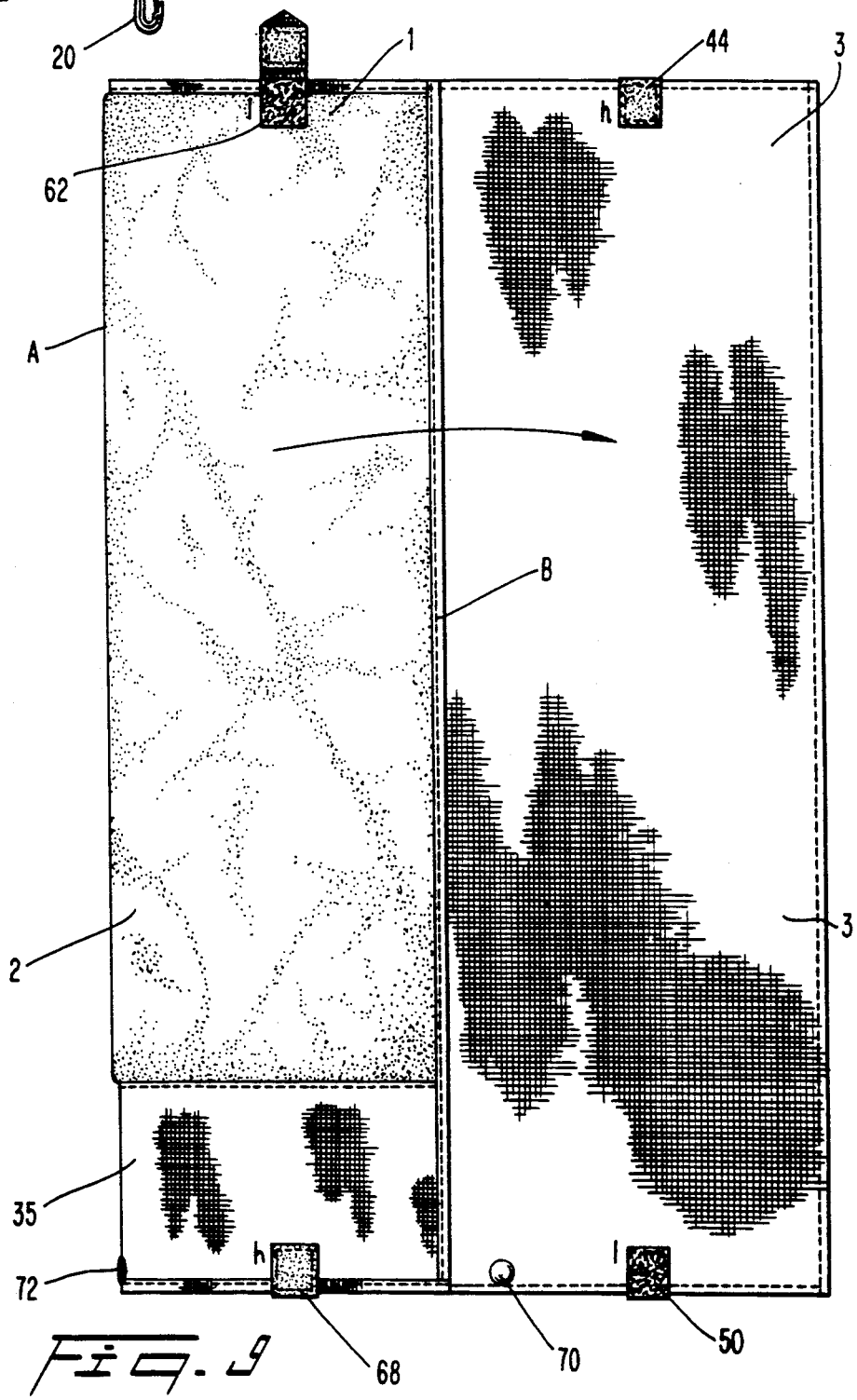
Fig. 9

COMBINATION COVER FOR GOLF CLUB BAGS AND TOWEL

TECHNICAL FIELD

This invention relates, generally, to accessories attachable to golf club bags. More particularly, it relates to a flat, foldable member formed of sheet material having a water repellant first surface and a towel-like second surface.

BACKGROUND ART

Golf club bags are of course open ended and thus the open end must be closed when precipitation occurs if the clubs and the inside of the bag are to be protected. Bag manufacturer provide a hood for such use, but most golfers simply stuff that hood into the bag when the weather is fair; thus, the hood is difficult to retrieve when needed.

Golf club bags do not come equipped with towels, however. On any golf course at any time, nearly every golf bag on the course will have a towel attached thereto by some means rigged up by the golfer because towels are very handy on a golf course, especially if the course is wet.

Accordingly, inventors have developed accessory items in the form of combination hoods and towels. For example, a reversible hood is shown in U.S. Pat. No. 4,498,579 to Brick. A first side of the hood is formed of a water repellant material and a second side thereof is formed of a towel-like material. The device, when not in use as a hood, is releasably attachable to the golf club bag in its reversed configuration, i.e., with its towel side out. When in use as a hood, the water-repellant side is out and the towel side becomes inaccessible. Thus, the Brick device is usable as a hood or as a towel, but it cannot be used as a towel when it is being used as a hood, i.e., the conversion into a hood deletes the towel function. Since a towel is most needed during light drizzles, the loss of the towel function during such times is a significant limitation of the Brick device.

Thus, there is a need for a combination hood and towel that retains its towel function when in its hood configuration, but the prior art, considered as a whole, neither teaches nor suggests to those of ordinary skill in this art how such a desirable combination device could be provided, as evidenced by the collective failure of earlier workers in this field to produce the novel construction disclosed hereinafter.

DISCLOSURE OF INVENTION

The longstanding but heretofore unfulfilled need for a combination hood and towel for golf club bags that retains its utility as a towel when being used as a hood is now provided in the form of a unique device that is folded flat and releasably secured to a golf club bag when being used as a towel and that is unfolded but still flat when being used to cover the golf club heads during precipitation. When used as a cover, a water repellant side thereof protects the clubs and the inside of the bag from the elements, but the golfer may still reach under the device to use the towel side thereof when needed. Thus, the towel function is not lost when the device is in its club-covering configuration.

Thus it is understood that the primary object of this invention is to provide a combination golf club cover and towel that performs both a hood function and a towel function at the same time.

Additional objects, features and advantages of the invention will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which:

FIG. 5 is a front elevational view of the device in its fully folded configuration;

FIG. 6 is a side elevational view of the device being unfolded from its FIG. 5 position along a transverse folding line;

FIG. 7 is a front elevational view showing the device after it has been unfolded along said transverse line as depicted in FIG. 6;

FIG. 8 is a top plan view showing a further unfolding of the device along a longitudinal folding line;

FIG. 9 is a front elevational view of the device when unfolded along a first longitudinal folding line;

FIG. 10 is an elevational view of the device in its fully unfolded configuration, showing its water repellant side;

BEST MODES FOR CARRYING OUT THE INVENTION

Figure 1:
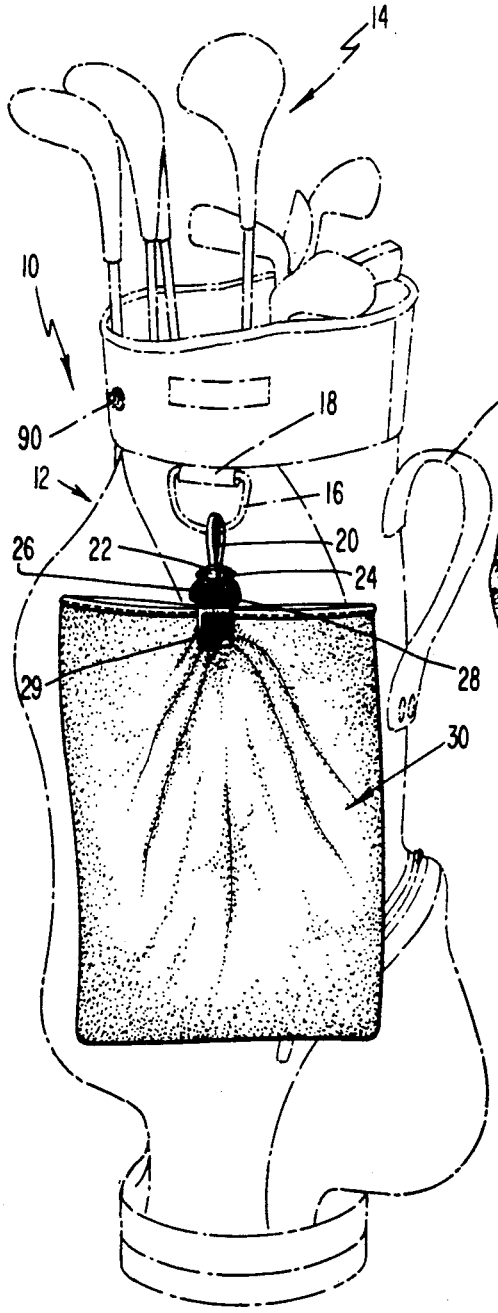
FIG. 1 is a perspective view of the novel device when in its fully folded configuration, showing it attached to a golf club bag which bag is shown in phantom lines.
Figure 2:
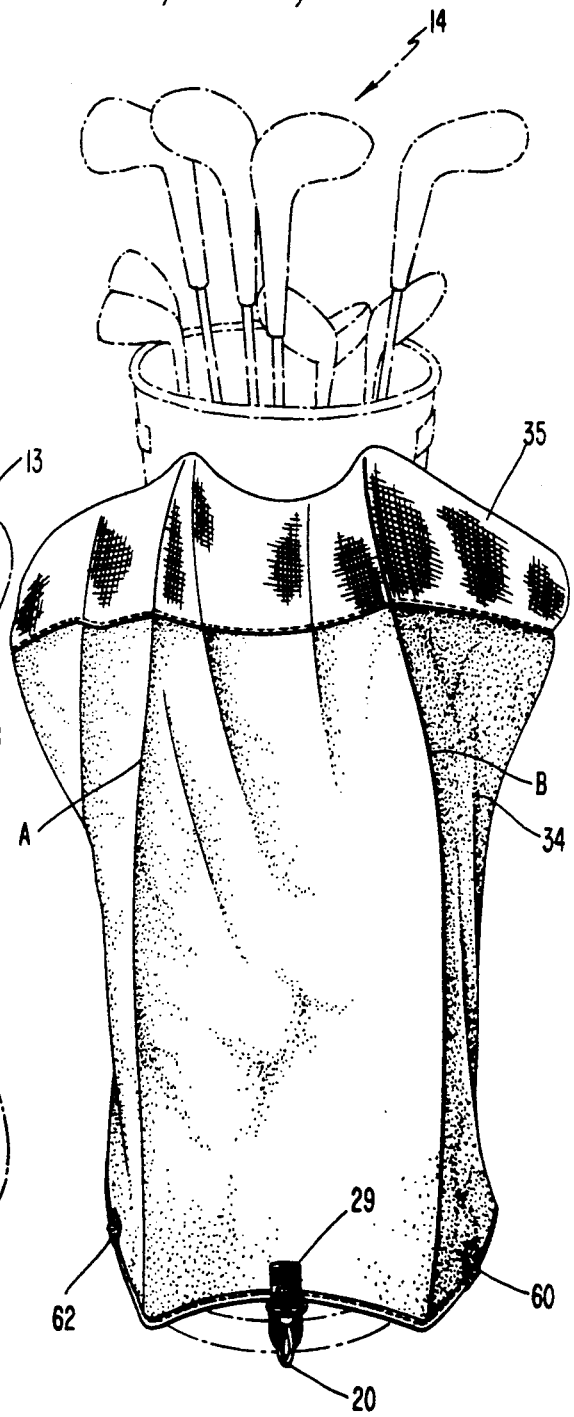
FIG. 2 is a perspective view of the device when unfolded and snapped onto a golf club bag, showing the towel side thereof exposed for use as a towel.

The novel device and its environment are denoted as a whole in FIG. 1 by the reference numeral 10. Golf bag 12 holds clubs 14 and is of conventional construction. It includes a "D"-shaped ring 16 having its straight part captured within sleeve 18 as depicted. Many golfers extend a towel through this ring 16. The present invention includes a split clamp member 20 that releasably engages D-ring 16. The base 22 of clamp 20 is held against rotation by a pin 24 that has its opposite ends held by clevis 26 and the straight part of the clevis is captured in a sleeve formed by a loop of material 28. Importantly, clamp 20 is rotatable relative to base 22, as indicated by the unnumbered line therebetween, i.e., clamp 20 is a swivel clamp.

Patch 29 is a piece of material integral to loop 28 and is sewed or otherwise suitably attached to the novel device 30. Although not shown in FIG. 1, another piece of material underlies patch 29 and terminates in a flexible flap that holds device 30 in the configuration shown in FIG. 1, as will become clear as this description proceeds. Device 30 may be positioned relative to bag 12 as shown in FIG. 1, or it may be rotated one hundred eighty degrees due to the swivel construction of clamp 20. It should also be understood from the outset that device 30 is easily releasable from D-ring 16 by compressing split clamp 20 in the well known way.

Figure 11:
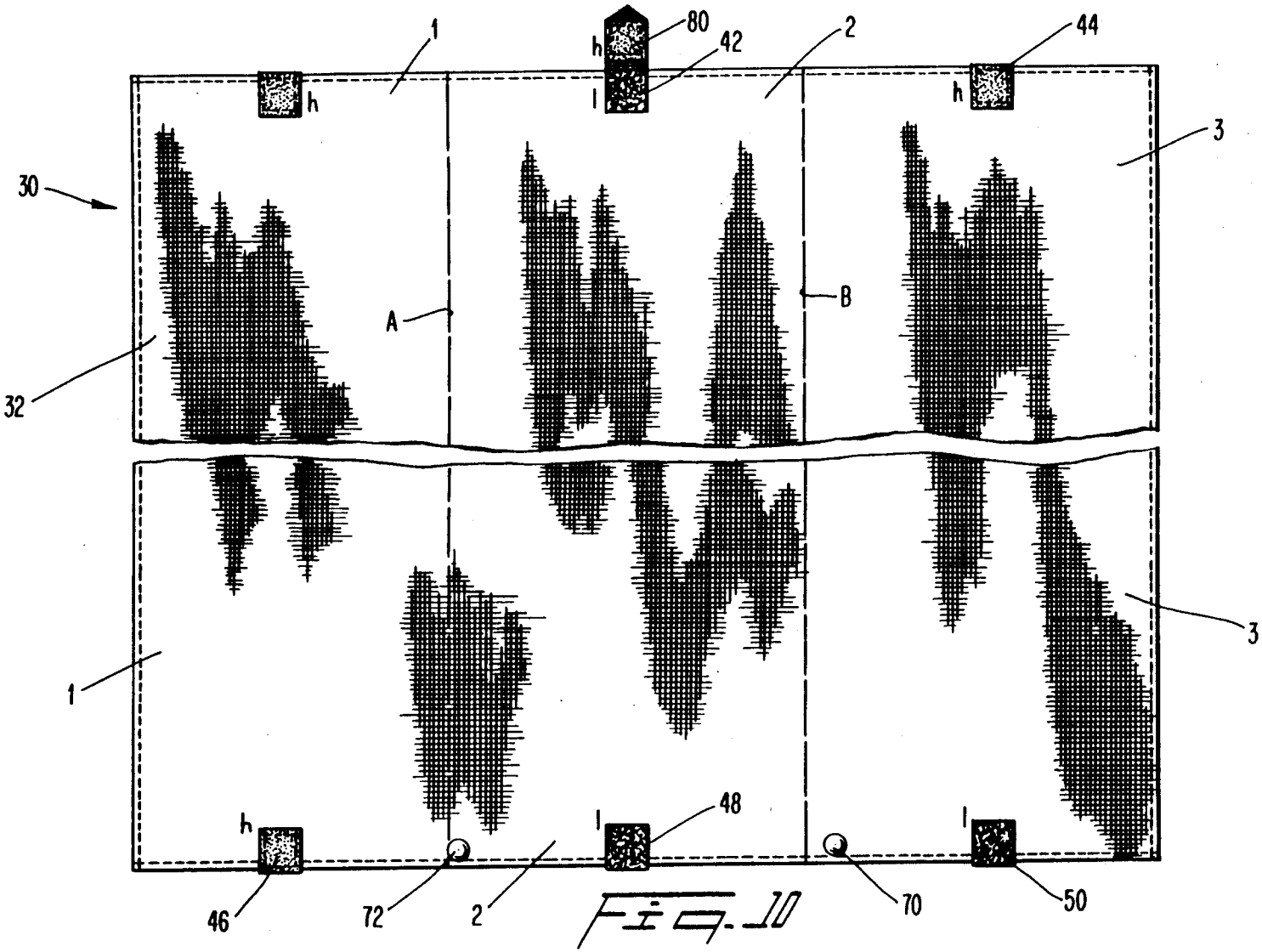
FIG. 11 is a front elevational view of the device in its fully unfolded configuration, showing its towel side.
Figure 17:
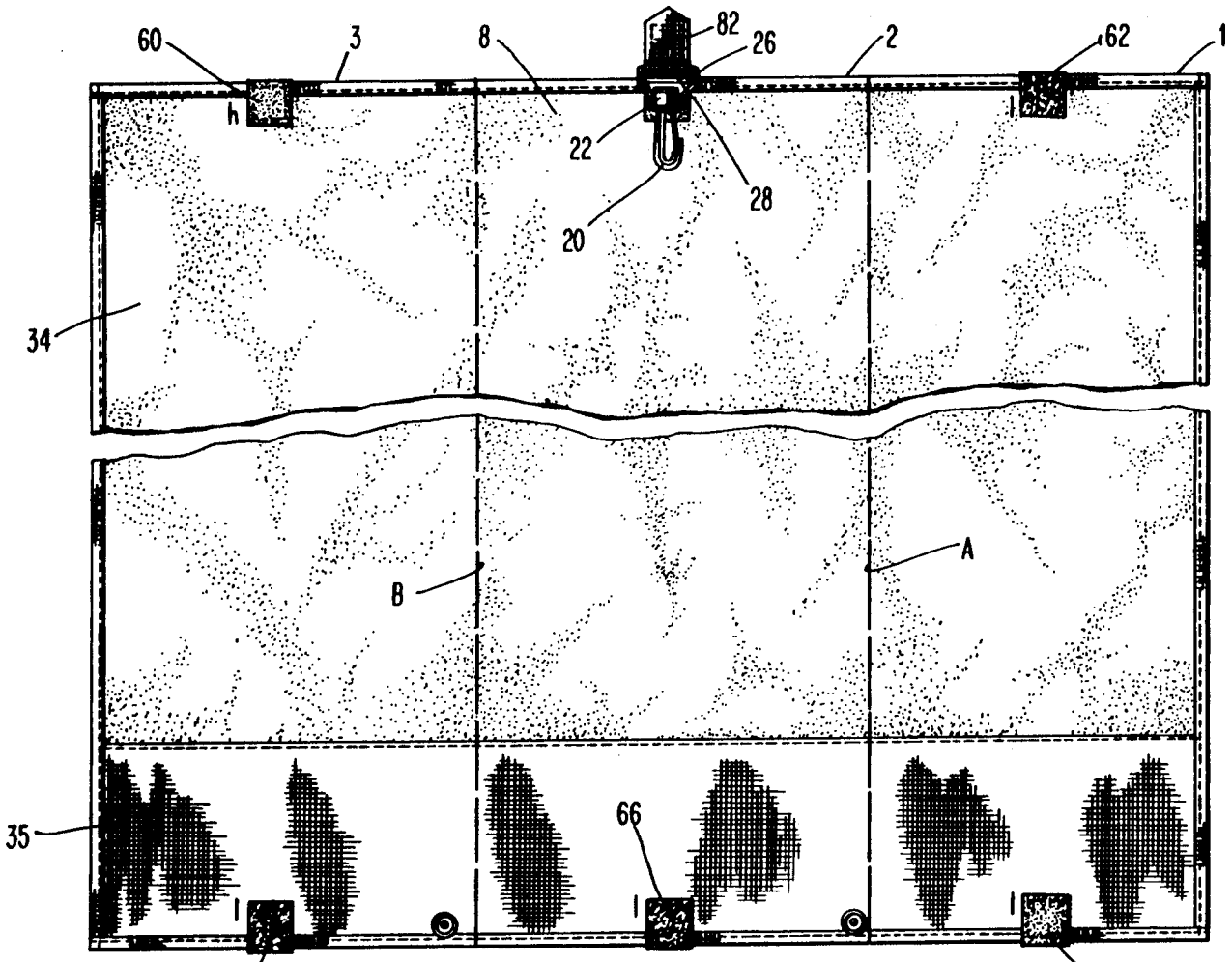

FIGS. 2–9 will be better understood if reference is first made to FIGS. 10 and 11. In FIG. 10, device 30 is shown in its completely unfolded configuration with its water repellant side 32 facing the viewer. In a commercial embodiment of the invention, member 30 is longer than it is wide; in FIG. 10, the longitudinal extent of device 30 has been truncated as indicated by the break in said FIG., with the result that the width or transverse extent of the member 30 may appear to exceed the length or longitudinal extent thereof.

A pair of parallel, longitudinally extending, laterally spaced apart fold lines A and B subdivide device 30 into three substantially equal sections as shown, which sections will be referred to as sections 1, 2 and 3 as shown.

FIG. 11 shows the towel or water-absorbant side 34 of device 30; since FIG. 11 is a reverse view of member 30 relative to FIG. 10, sections 1, 2 and 3 appear in reverse order, of course. It should be understood that a single sheet of material could be provided with a towel side and a water repellant side, although it is believed to be more economical to make the novel device 30 by joining the peripheral edges of a sheet of water repellant material to a sheet of water absorbent material. Both constructions are within the scope of the claims that follow.

Hook and loop fasteners, or other suitable quick release fastening means, are positioned at strategic locations on both the repellant side 32 and the absorbent side 34. Specifically, on the repellant side 32, a hooked patch 40 is permanently secured as by sewing or other suitable means to the upper peripheral edge of section 1, substantially centrally thereof, patch 42 is a loop-carrying patch secured to the upper peripheral edge of central section 2, and hooked patch 44 is similarly positioned with respect to section 3. Hooked patch 46 and looped patches 48, 50 are secured adjacent the lower peripheral edge of sections 1, 2 and 3, respectively, as shown.

Similarly, as shown in FIG. 11, patches 60 (hooks) and 62 (loops) are secured to the upper peripheral edges of section 3 and 1, respectively, and patches 64 (loops), 66 (loops), and 68 (hooks) are secured to the lower edges of sections 3, 2, and 1, respectively.

Metallic snap members 70 and 72 are also positioned adjacent the lowermost peripheral edge of device 30, near folding lines B and A, respectively, in FIG. 11. The protruding or coupling part of each snap appears in FIG. 11; the head or non-coupling end of each snap is shown in FIG. 10, it being understood that each snap member extends through device 30 in rivet fashion.

Another hook-carrying patch 80 is shown in FIG. 10 at the top center of center panel 2; it is carried by flap 82. Flap 82, as shown in FIG. 11, carries no hooks or loops on the side thereof opposite patch 80. Flap 82, mentioned earlier, holds device 30 in its fully folded configuration as shown in FIGS. 1 and 5, as will become more clear as this description proceeds.

The steps required to fold device 30 from its completely unfolded configuration as depicted in FIGS. 10 and 11 into its FIG. 1 or FIG. 5 position are as follows: a first fold is made along folding crease A (see FIG. 10) and upper hook patch 40 and lower hook patch 46 of section 1 are brought into registration with upper loop patch 42 and lower loop patch 48 of section 2, respectively. Section 1 now overlies section 2 as shown in FIG. 9. Upper hooked patch 44 and lower loop patch 50 of section 3 (FIG. 10) are then brought into registration with upper looped patch 62 and lower hooked patch 68 of section 1, respectively, i.e., a fold is made along crease B so that section 3 overlies section 1. This produces the configuration of FIG. 7. Lower loop patch 64 (FIG. 7) is brought into registration with upper hooked patch 60 of section 3, i.e., the device 30 is folded along crease C as shown in FIG. 6. Flap 82 carrying hooked patch 80 (FIG. 10) is then folded over to engage lower looped patch 66 (FIG. 11) to produce the configuration of FIG. 5. When the configuration of FIG. 5 is swiveled one hundred eighty degrees, it appears as shown in FIG. 1.

Figure 4:
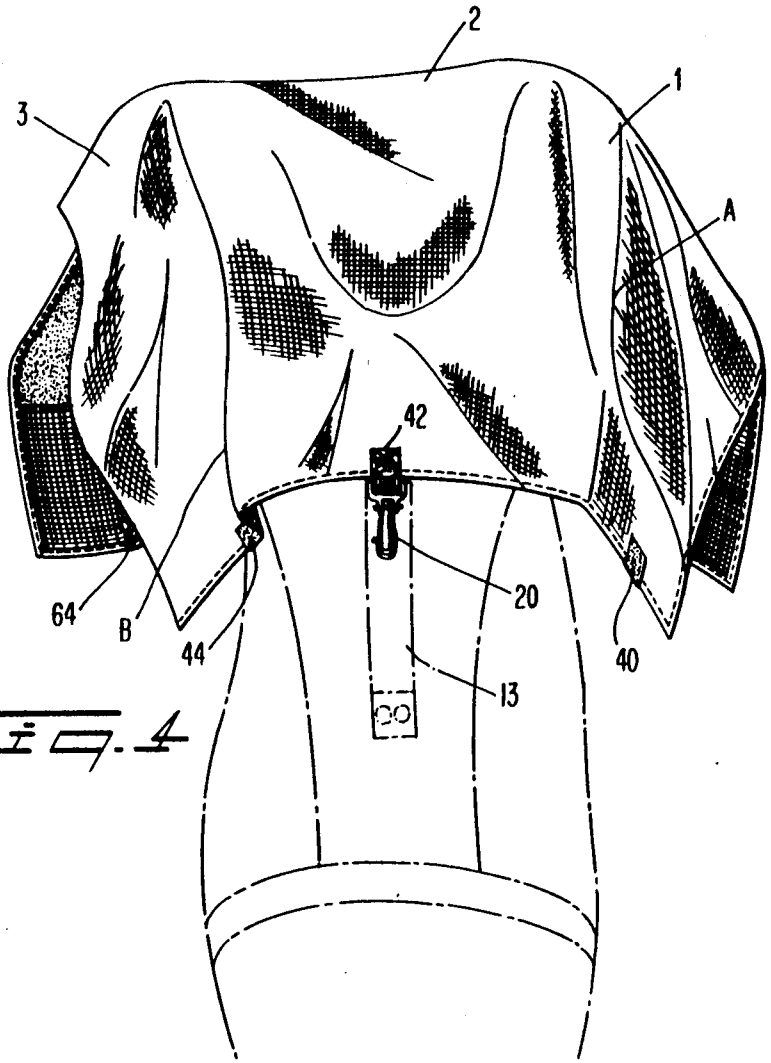
FIG. 4 is a perspective view taken from the opposite side of the view in FIG. 3.
Figure 3:
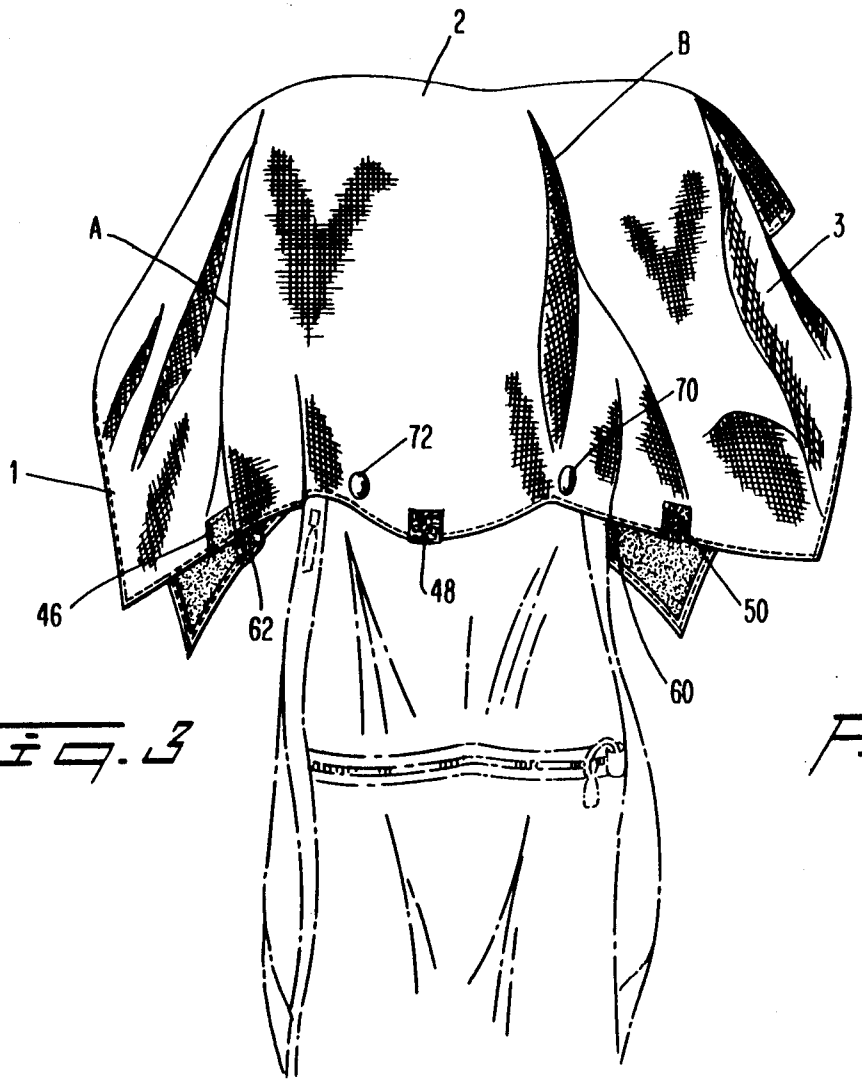
FIG. 3 is a perspective view of the device with the water repellant side exposed to the elements and the towel side being protected from the elements but accessible to the golfer.

Golf club bags of conventional construction usually include a couple of metallic snap members near the open end thereof; one of said snap members is shown in FIG. 1 and is denoted 90. Its counterpart is not shown. Complementally formed snap members 70, 72 are releasably engaged to the bag snaps 90 and its counterpart in the configuration shown in FIG. 2, and the device 30 is in its unfolded configuration with its towel side facing the viewer. Water repellant part 35 thereof abuts the bag as shown. Once device 30 is snapped onto the golf bag in the manner depicted in FIG. 2, its utility as a towel is obvious, and the ease with which said device 30 can be flipped over to protect the golf clubs is equally apparent. FIGS. 3 and 4 depict device 30 when it has been flipped over the clubs so that its water repellant side 32 is exposed to the elements. Note in FIG. 4 that clamp 20 could be engaged to handle 13 of the bag 12 to hold the device down if desired.

Figure 12:
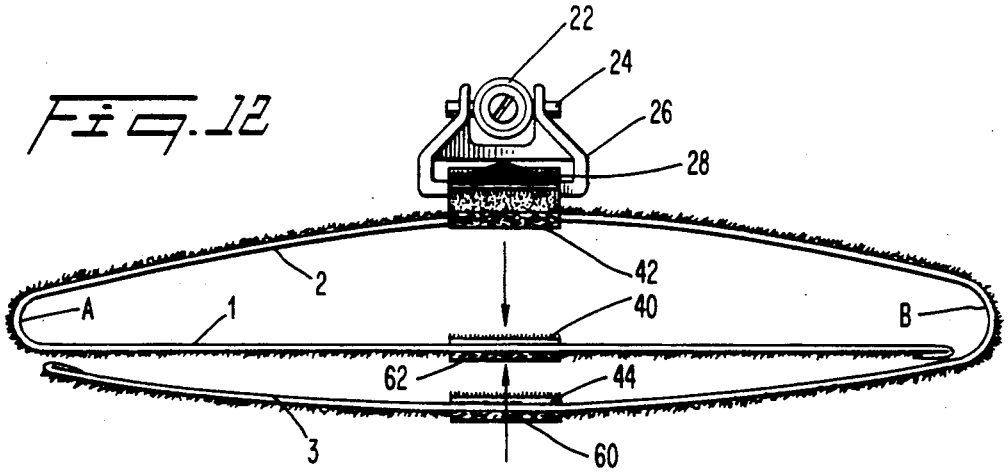
FIG. 12 is a top plan view of the device when trifolded along a pair of laterally spaced longitudinal folding lines, but before the hook and loop fasteners have been engaged to one another.
Figure 13:
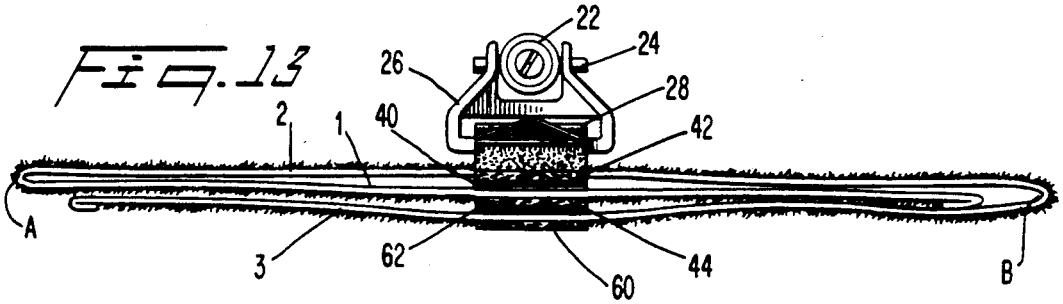
FIG. 13 is a plan view of the parts shown in FIG. 12 after the hook and loop fasteners have been engaged to one another.
Figure 14:
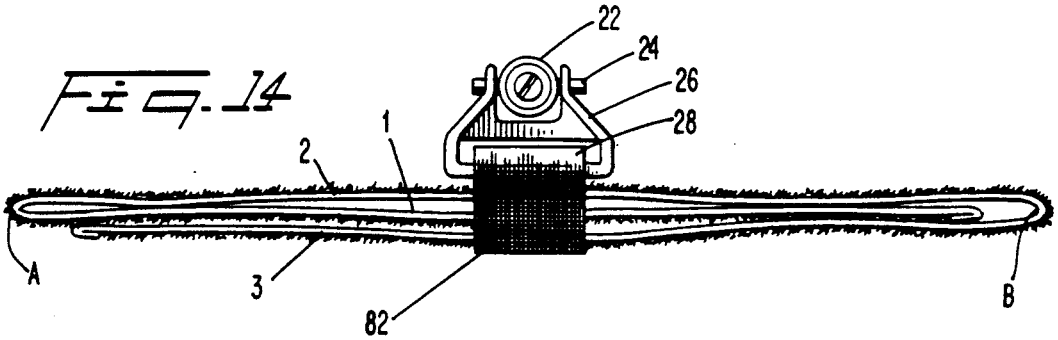
FIG. 14 is a top plan view showing the same parts as FIG. 13, but showing the flexible flap member in its extended configuration.
Figure 15:
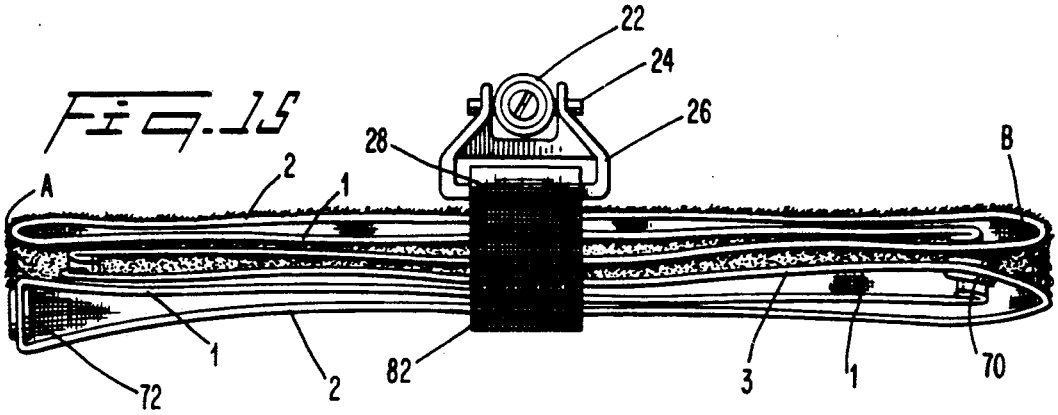
FIG. 15 is a top plan view of the device when in its FIG. 5 position, showing the flap engaging a lowermost peripheral edge of the device.

FIGS. 12–15 provide an animation of the folding process already described above. FIG. 12 shows the initial trifold before the various fastener members are joined together and FIG. 13 shows them after such union but before flap 82 is folded over so that hooks 80 engage loops 66. FIG. 14 shows flap 82 in its extended configuration and FIG. 15 depicts hooks 80 engaged with loops 66, i.e., FIG. 15 is a top plan view of the device 30 when in its FIG. 1 or FIG. 5 configuration.

This invention is clearly new and useful. Moreover, it was not obvious to those of ordinary skill in this art at the time it was made, in view of the prior art considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention which, as a matter of language, might be said to fall therebetween.

Now that the invention has been described,

What is claimed is:

1. An article of manufacture, comprising:

a first flat, flexible, foldable piece of sheet material of predetermined configuration and dimension;

a second flat, flexible, foldable piece of sheet material of predetermined configuration substantially equal to the predetermined configuration and dimension of said first piece of material;

said first piece of material being formed of a water-repellant material and defining a first side of said article;

said second piece of sheet material defining a second side of said article and being formed of a water-absorbant material and a strip of water-repellant material, said strip of water-repellant material being positioned adjacent a lowermost peripheral edge of said second side and being disposed in overlying relation to a lower part of said water-absorbant material;

said first and second pieces of sheet material being disposed in registration with one another and being permanently joined to one another about their respective peripheral edges;

a first predetermined plurality of cooperative releasable fastening members being disposed on said first side of said article and being permanently secured to said first material in equidistantly spaced relation to one another along an uppermost peripheral edge of said first side of said article;

a second predetermined plurality of cooperative releasable fastening members being disposed on said first side of said article and being permanently secured to said first material in equidistantly spaced relation to one another along a lowermost peripheral edge of said first side of said article, said second plurality of fastening members being disposed in alignment with corresponding fastening members of said first plurality of fastening members;

a third predetermined plurality of cooperative releasable fastening members being disposed on said second side of said article and being permanently secured to said second material in equidistantly spaced relation to one another along an uppermost peripheral edge of said second side of said article;

a fourth predetermined plurality of cooperative, releasable fastening members being disposed on said second side of said article and being permanently secured to said strip of said first material that overlies a lower part of said second material in equidistantly spaced relation to one another along a lowermost peripheral edge of said second side of said article, said fourth plurality of fastening members being disposed in alignment with corresponding fastening members of said third plurality of fastening members;

a releasable clamp member being permanently secured to a preselected peripheral edge of said article;

whereby said article is foldable in accordance with a preselected folding pattern;

whereby said fastening members of said first, second, third, and fourth plurality of fastening members releasably engage predetermined cooperative fastening members thereof as each fold is made to inhibit unwanted unfolding of the article; and whereby said clamp member is employed to releasably secure the article to a golf bag.

2. The article of claim 1, wherein said first, second, third and fourth predetermined plurality of fastening members is three.

3. The article of claim 2, wherein said third plurality of fastening members includes a flap member disposed intermediate two of said fastening members in said third plurality of fastening members.

4. The article of claim 3, wherein said flap member has a fastening member secured to a first side thereof, said flap member fastening member adapted to releasably engage a preselected fastening member of said fourth plurality of fastening members and wherein said flap member has a second side that is not adapted to engage any of said first, second, third, or fourth plurality of fastening members.

5. The article of claim 4, further comprising a pair of snap members disposed adjacent said lowermost peripheral edge of said second material, said snap members adapted to releasably engage a pair of complementally formed snap members built into said golf club side of said article.

* * * * *